United States Patent [19]

Colomb et al.

[11] Patent Number: 4,763,042

[45] Date of Patent: Aug. 9, 1988

[54] VACUUM ENVELOPE FOR A RADIATION IMAGE INTENSIFYING TUBE AND A PROCESS FOR MANUFACTURING SUCH AN ENVELOPE

[75] Inventors: Gilbert Colomb, Voiron; Jean P. Creusot, St. Martin d'Heres; Henri Rougeot, St. Nazaire les Eymes, all of France

[73] Assignee: Thomson-CSF, Paris, France

[21] Appl. No.: 736,474

[22] Filed: May 21, 1985

[30] Foreign Application Priority Data

May 30, 1984 [FR] France ..... 84 08500

[51] Int. Cl.[4] ..... H01J 35/18

[52] U.S. Cl. ..... 313/544; 313/420; 220/2.1 R

[58] Field of Search ..... 313/544, 420, 283, 527, 313/529; 220/2.1 R, 2.1 A, 2.3 A; 378/161; 445/44

[56] References Cited

U.S. PATENT DOCUMENTS

| | | | |
|---|---|---|---|
| 1,639,575 | 8/1927 | Robinson | 220/2.1 R |
| 2,708,250 | 5/1955 | Day | 313/282 |
| 3,335,310 | 8/1967 | Ney | 220/2.1 R |
| 3,419,741 | 12/1968 | Legendre | 378/161 |
| 3,603,759 | 9/1971 | Peacock | 219/9.5 |
| 3,878,417 | 4/1975 | Eberlein | 313/420 |
| 4,045,699 | 8/1977 | Gunther | 313/529 |
| 4,119,234 | 10/1978 | Kotschak et al. | 313/420 |
| 4,122,967 | 10/1978 | Rohrich | 313/420 |
| 4,238,043 | 12/1980 | Minami et al. | 220/2.1 R |
| 4,331,898 | 5/1982 | Shimizu et al. | 313/527 |
| 4,422,008 | 12/1983 | Aramaki et al. | 313/544 |
| 4,423,351 | 12/1983 | Sugimori et al. | 313/420 |

FOREIGN PATENT DOCUMENTS

| | | | |
|---|---|---|---|
| 23051 | 1/1981 | European Pat. Off. | 313/527 |
| 1579461 | 7/1969 | France . | |
| 2305850 | 10/1976 | France . | |

OTHER PUBLICATIONS

Welding Production, vol. 25, No. 9, September 1978, pp. 19–20, Cambridge, GB; K. K. Khrenov et al.: "The Formation . . . ".

Patents Abstracts of Japan, vol. 6, No. 55 (E-101) [933], 10 Avril 1982; & JP-A-56 167 246 (Tokyo Shibaura Denki K.K.) 22-12-1981.

*Primary Examiner*—Stewart J. Levy
*Assistant Examiner*—Hezron E. Williams
*Attorney, Agent, or Firm*—Roland Plottel

[57] ABSTRACT

The present invention provides a vacuum envelope for a radiation image intensifying tube and a process for manufacturing same. In a vacuum envelope of the type comprising a central body, an input window made from aluminum or an aluminum alloy at one end of said central body and a transparent output window at the other end of the body, said input window comprises a peripheral skirt fitting over a ring having the same section as said skirt, and made from iron or an iron alloy, integral with the end of the body, said skirt being welded to the ring by magnetic induction welding so as to be vacuum tight.

15 Claims, 2 Drawing Sheets

Fig.1
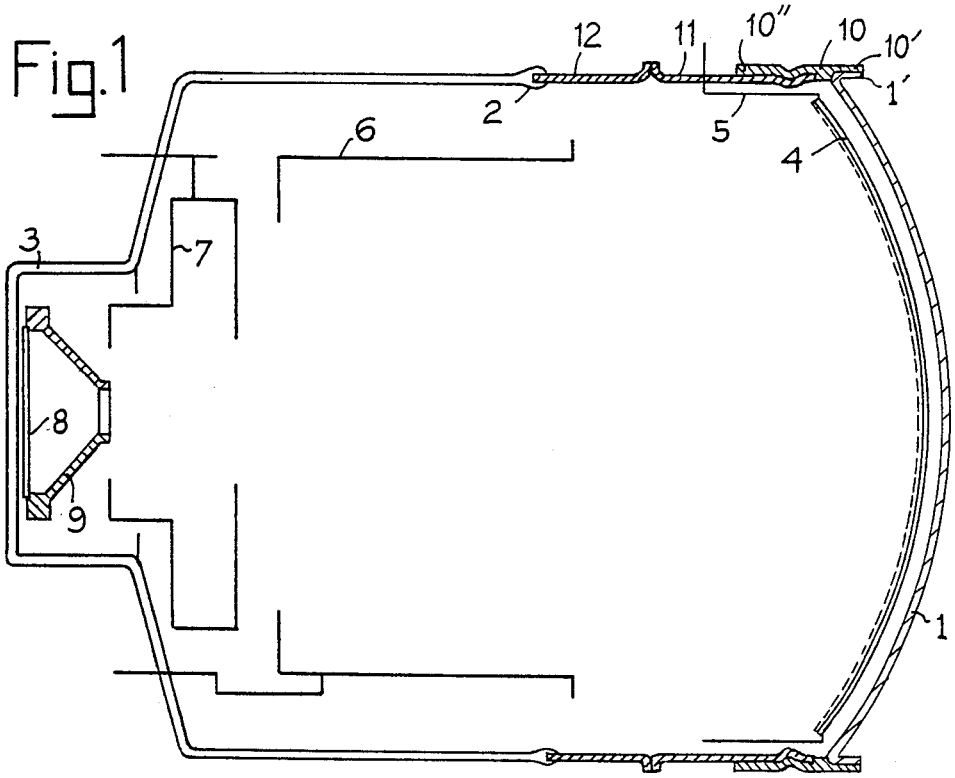
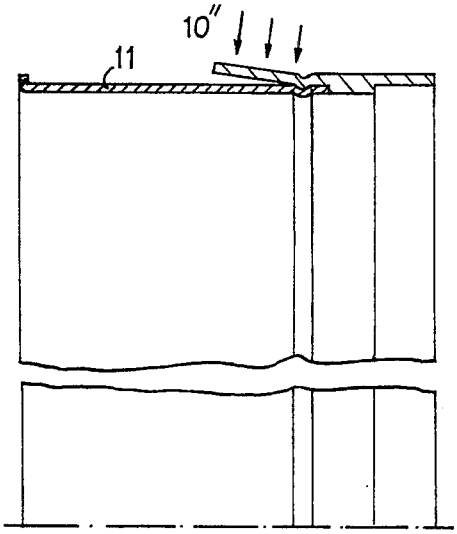
Fig.2
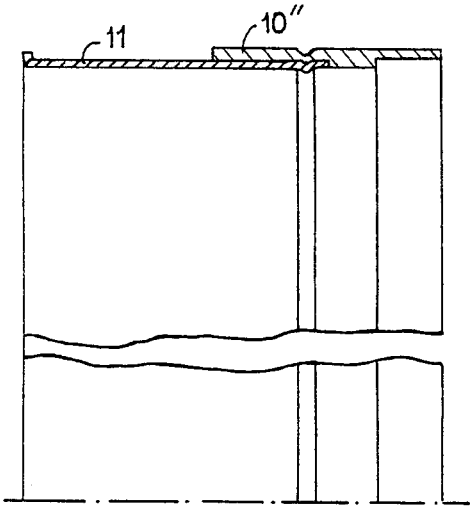
Fig.3

VACUUM ENVELOPE FOR A RADIATION IMAGE INTENSIFYING TUBE AND A PROCESS FOR MANUFACTURING SUCH AN ENVELOPE

BACKGROUND OF THE INVENTION

1. Field of the Invention

The present invention relates to the structure of the vacuum envelope for radiation image intensifying tubes such as radiological image intensifying tubes or similar electron tubes. The present invention also relates to a process for manufacturing these envelopes.

In a way known per se, the vacuum envelopes for image intensifying tubes are formed by a central body of revolution, by an input window for the passage of the radiation to be amplified, said window being connected to one end of the central body and by a transparent output window connected to the other end of the central body.

2. Description of the Prior Art

Until recently, the input windows were generally made from glass, which raised few sealing problems with the central body even when this latter was partly made from metal, for glass-metal sealing is well known to those skilled in the art. However, the use of glass for the input windows raises a number of problems. Thus, absorption of the radiation, in particular of the X rays, in the glass window varies from 15% to 25% depending on the thickness of the glass used. Now the thickness of the glass increases with the size of the tube and may vary between 2 and 3.5 mm. In addition, considerable diffusion of the radiation has been noted due to the thickness of the glass.

To overcome these disadvantages, it has been proposed to form the input window from a metal permeable to the radiation to be transmitted.

Thus vacuum envelopes have been proposed comprising a concave input window made from titanium or steel. Although this type of window may remain sufficiently thin, so absorbing or diffusing little of the radiation to be transmitted, and nevertheless sufficiently strong mechanically to withstand pressure differences, it is however necessary, because of the concave shape of the window, to extend the tube so as to be able to incorporate therein the input screen which is convex for the requirements of the electronic optical system.

Thus, it has been proposed to use windows made from aluminium or an aluminium alloy having a convex shape. In this case, different techniques are used for sealing the window to the central body.

Thus, as described in French Pat. No. 2. 482 366, sealing between the window and the central body may be achieved by thermo-compression welding. In this case, the aluminium or aluminium alloy convex window comprises an annular peripheral flange and assembly between the window and the body requires either the body to comprise an annular flange perpendicular to the axis of the tube or the use of an L or S shaped connecting ring. In fact, so as to be able to carry out thermo-compression welding, the parts to be welded must be situated in a plane perpendicular to the axis of the tube so as to be able to apply a pressure between the two metals or alloys from which the window and the central body are formed.

This technique has the drawback of increasing the overall diameter of the tube. Furthermore, the thermo-compression welding process, in particular when it is used for welding aluminium to an iron alloy such as stainless steel, requires a rise in temperature and a period of contact under pressure which are time consuming. The result is that this process is industrially expensive.

Another solution of the prior art consists in forming the window by using a convex shaped piece made from a material comprising a layer of copper plated on an aluminium layer in which the copper layer is removed in the part subjected to the radiation and the aluminium layer is removed at the level of the edge formed by a flat portion surrounding the convex skull cap, thus conserving a localized covering of the two layers. The copper edge is then welded by electric arc welding along a lip formed on the central metal body which may be made from stainless steel. With this process, we find again the same problems of overall diameter of the tube as with thermocompression welding. Furthermore, it is difficult to obtain an industrially produced two layer material which always has the same reciprocal quality of adherence with vacuum tightness. In addition, metal must be removed before being able to carry out the welding.

SUMMARY OF THE INVENTION

The aim of the present invention is to provide a new vacuum envelope structure for radiation image intensifying tubes comprising an aluminium window which does not have the drawbacks of the structures of the prior art.

An aim of the present invention is also to provide a new vacuum envelope structure for radiation image intensifying tubes which can be readily and quickly produced.

Consequently, the present invention provides a vacuum envelope for radiation image intensifying tubes or similar electron tubes comprising a central body and an input window made from aluminium or an aluminium alloy at one end of the central body, said input window comprising a peripheral skirt fitting onto a ring having the same section as the skirt, made from iron or an iron alloy integral with said end of the body, said skirt being welded to said ring by magnetic induction welding so as to be vacuum tight.

The magnetic induction welding technique has been known for a long time for welding small diameter tubes with good sealing with respect to the pressure of different fluids. It is described in particular in French Pat. No. 1 579 461. However, this technique has never been used for image intensifying tubes.

In fact, since the tubes are of large diameter, it seemed impossible for a man skilled in the art to be able to effect a vacuum tight weld, using magnetic induction, over such a large length. In fact, the applicant has had to solve numerous problems of leakage met with during tests by providing a special shape for the window.

BRIEF DESCRIPTION OF THE DRAWINGS

Other features and advantages of the present invention will be clear from the following description of a preferred embodiment with reference to the accompanying drawings in which:

FIG. 1 is a schematical sectional view of the vacuum envelope of an image intensifying tube according to a preferred embodiment of the present invention;

FIG. 2 is a sectional view of the essential part of the embodiment shown in FIG. 1, before welding;

FIG. 3 is a view identical to that of FIG. 2, after welding,

In the Figures, the same references designate the same elements.

DESCRIPTION OF THE PREFERRED EMBODIMENTS

Figure 4:
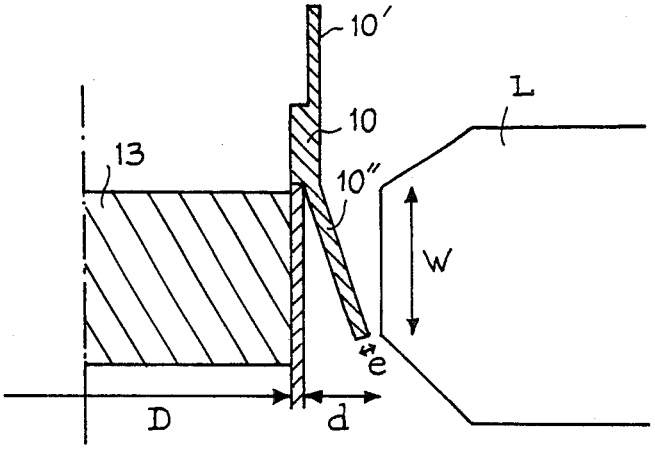
FIG. 4 is a diagram explaining the procedure for manufacturing the envelope used in the present invention.

As shown in FIG. 1, the vacuum envelope of the present invention, when it is used for an image intensifying tube, comprises essentially a window 1 for inputting the radiation to be detected, such as X rays, a central body 2 of revolution having substantially the same diameter as the input window, formed mainly by a glass cylinder ending in an output window 3 forming an integral part of body 2. In addition, inside the envelope have been shown schematically the main elements forming the image intensifying tube such as the photocathode 4, the acceleration and focusing electrodes 5, 6, 7 and an output screen 8 terminating the last electrode or anode 9.

The input window 1 is made from aluminium or an aluminium alloy, preferably from an aluminium and magnesium alloy such as $Ag_4MC$ which is sufficiently rigid for withstanding the pressure differences between the outside and the inside of the tube. The input window has the shape of a convex skull cap.

In accordance with the invention, the input window 1 comprises a peripheral skirt 10 fitted over a ring 11 extending the central body. In the embodiment shown, the input window 1 comprises a peripheral part 1' bent back in a plane parallel to the axis of the tube. The peripheral skirt 10 is formed by a ring having a substantial T shaped section made from aluminium or an aluminium alloy, preferably aluminium, for facilitating welding to ring 11 which is made from iron or an iron alloy, preferably from stainless steel as will be explained hereafter. One branch 10' of the ring is welded to the peripheral part 1'. However, the input window 1 and skirt 10 may be formed as a single piece when they are made from the same material. As shown in FIG. 2, before being welded to ring 11, the skirt ends in a cone shaped bell-mouthed portion 10" having a projection (part "I" of the "T") on which is applied the end of the ring 11. In order to be able to weld using magnetic induction welding in accordance with the invention, the opening angle of the bell-mouthed part 10" is between 1 and 30° with respect to the axis of the tube.

Furthermore, as shown in FIG. 1, an intermediate ring 12 is provided between the glass part of the central body 2 and ring 11. This intermediate ring is made from iron or an iron alloy, preferably from an iron-nickel-cobalt alloy such as Dilver or from an iron-nickel alloy such as Carpenter.

The purpose of the intermediate ring is to facilitate welding to the glass portion, particularly when ring 11 is made from stainless steel. However, it is obvious for a man skilled in the art that the two rings 11 and 12 may be formed as a single piece when they are made from the same material.

Figure 5:
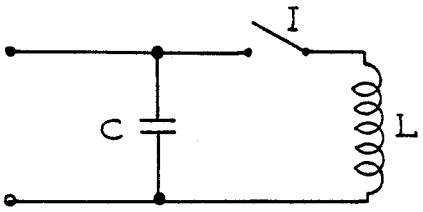
FIG. 5 is an electric circuit used in the process of the present invention.
Figure 6:
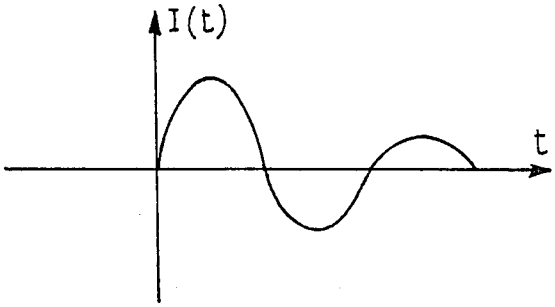
FIG. 6 is a time-induced current curve during discharge of the condenser in the circuit of FIG. 5.

Referring more particularly to FIGS. 4 to 6, the process will now be explained for providing vacuum tight sealing between ring 11 made from iron, or an iron alloy, preferably from stainless steel and the aluminium skirt 10. In accordance with the invention, sealing is achieved by magnetic induction welding, more particularly by pulsed magnetowelding.

For such welding, ring 11 is mounted on a mandrel 13 and the bell-mouthed end of skirt 10 is fitted over ring 11. As shown in FIG. 1, ring 11 and skirt 10 both have, at the level of the bend, a notch shaped indentation of identical shape. This indented part gives rigidity to the stainless steel ring 11 and defines the point of rotation of the bell-mouthed portion of the skirt.

Furthermore, the cylindrical skirt 10 is surrounded by a magnetic induction coil L. For pulsed magnetic induction welding, coil L forms, with a capacitor C and switch I, an oscillating circuit as shown in FIG. 5.

Thus, for welding the bell-mouthed end 10" of the aluminium skirt to the stainless steel ring 11 by magnetic induction, capacitor C is charged to a high voltage and then is discharged in coil L.

The magnetic field which appears in coil L creates an induction current, having the form shown in FIG. 6, in the bell-mouthed portion of skirt 10 made from aluminium which is a high conducting material. The result is a mechanical force which causes the bell-mouthed portion of skirt 10 to be applied to the stainless steel ring 11, as shown in FIG. 3. The energy released, if it is sufficiently high, drives away the surface oxide of the aluminium and welds the two materials together because, so it is thought, of the molecular agitation which then occurs at this level.

It will be recalled that the current induced in the bell-mouthed portion 10" is limited to the skin thickness. Consequently, the thickness of this bell-mouthed portion 10" has been chosen equal to the skin thickness. It is possible to choose a greater thickness but, in this case, the energy released during magnetic induction welding must be higher.

An example will be given hereafter of the dimensions of the essential parts of the envelope and of the welding parameters for implementing the above process.

Let it be assumed that it is desired to provide vacuum type sealing, using pulsed magneto welding, of an $Ag_4MC$ window from 0.8 to 1 mm in thickness, of a convex shape, welded to a cylindrical shirt of 2 mm in thickness having a bell-mouthed portion of 0.5 mm in thickness on a stainless steel ring. The opening angle of the bell-mouthed part is 7°.

As recalled above, the current in the aluminium is limited to the skin thickness $$\tau = \sqrt{\frac{\rho}{\pi \mu F}}$$

with

F: natural frequency of the oscillation $\mu$: permeability of the air $4\pi 10^{-7}$ $\rho$: resistivity of aluminium 2 $\mu\Omega$cm if we assume $\tau = 0.5$ mm which corresponds to the thickness of the bell-mouthed portion, we have $$F = \frac{\rho}{\tau^2 \pi \mu} = 2.10^4 \text{ Hz}$$

The capacitor to be discharged may then be determined $$F = \frac{1}{2\pi\sqrt{LC}}$$

$$C = \left(\frac{1}{2\pi F}\right)^2 \times \frac{1}{L}$$

$$L = \frac{4\pi 10^{-7}\phi d}{w}$$

with $\phi = \pi D$

D=380 mm D: diameter of ring 11 d=3 mm d: opening of the bell-mouthed portion w=20 mm w: height of the bell-mouthed portion which gives L=200 nH and C=300 $\mu$F.

Charging this capacitor at 20 KV, energy of 60 KJ is available. If we assume an energy transfer efficiency of 4%, 2.4 KJ are available for welding. To carry out the welding, the speed of projection of the aluminium must reach 400 m/s. Taking into account the mass of the bell-mouthed portion, in the present case equal to 32 g, the kinetic energy required will be 2.5 KJ. This energy value is compatible with the above mentioned value of 2.4 KJ available for welding.

The manufacturing process of the invention is a rapid process since it is achieved by instantaneous discharge of a capacitor. It is consequently inexpensive on an industrial scale. Furthermore, it allows two cylinders to be tightly sealed to each other, which gives a tube with reduced overall diameter with respect to the tubes of the prior art. It is also possible with this process to reduce the diameter of the tube for a given field, which results in a reduction of weight of the tube.

Furthermore, it is obvious to a man skilled in the art that the present invention is not limited to image intensifying tubes, but that it may be applied to all electron tubes having a vacuum enclosure comprising an aluminium or aluminium alloy window.

What is claimed is:

1. A vacuum envelope for radiation image intensifying tubes comprising a central body (2) formed by a glass cylinder ending on one side in a cylindrical ring (11) made from iron or an iron alloy and on the other side in an output window (3); and an input window (1) made from aluminum or an aluminum alloy having substantially the same diameter as the body (2) provided with a peripheral skirt (10) ending in a cone shaped bell-mouthed portion before welding to said ring (11), said skirt (10) being welded to and overlying said ring (11) by magnetic induction welding so as to be vacuum tight.

2. The vacuum envelope as claimed in claim 1, wherein said skirt ends in a cone bell-mouthed portion having a projection inside on which is applied the end of said ring (11).

3. The vacuum envelope as claimed in claim 2, wherein the opening angle of the bell-mouthed portion is between 1 and 30°.

4. The vacuum envelope as claimed in claim 2, wherein, during magnetic induction welding, a current is induced in the aluminium or aluminium alloy on a given thickness called skin thickness and the thickness of said bell-mounted portion is equal to said skin thickness.

5. The vacuum envelope as claimed in claim 1, wherein said input window and said skirt are made from different materials and are fixed together so as to be vacuum tight.

6. The vacuum envelope as claimed in claim 5, wherein said window is made from an aluminium alloy and said skirt is made from aluminium.

7. The vacuum envelope as claimed in claim 1, wherein said iron alloy ring is made from stainless steel.

8. The vacuum envelope as claimed in claim 1, further comprising an intermediate ring between the body and said ring to which the window is welded.

9. The vacuum envelope as claimed in claim 8, wherein said intermediate ring is made from an iron alloy which is an iron-nickel alloy.

10. A process for manufacturing a vacuum envelope for radiation image intensifying tubes such as claimed in claim 1, wherein the end of said aluminium or aluminium alloy skirt (10) is fitted over the iron or iron alloy ring (11) and the end of the skirt, is sealed to said ring by magnetic induction welding during which the end of said skirt is applied to the ring and firmly secured thereto.

11. The process as claimed in claim 10, wherein the magnetic induction welding is achieved by using an induction coil surrounding the end of the skirt and into which is discharged a capacitor connected in an oscillating circuit.

12. The process as claimed in claim 11, wherein the natural oscillation frequency of said oscillating circuit is adjusted so as to obtain a skin thickness equal to the thickness of the end of said skirt.

13. The vacuum envelope as claimed in claim 1, wherein said iron alloy ring is made from an iron-nickel alloy.

14. The vacuum envelope as claimed in claim 1, wherein said iron alloy ring is made from an iron-nickel-cobalt alloy.

15. The vacuum envelope as claimed in claim 8, wherein said intermediate ring is made from an iron alloy which is an iron-nickel-cobalt alloy.

* * * * *